United States Patent [19]

Terry

[11] 4,023,281

[45] May 17, 1977

[54] PROTECTIVE FOOT COVERING

[76] Inventor: Ronnie L. Terry, 9301 Jamaica Drive, Cutler Ridge, Fla. 33157

[22] Filed: May 19, 1976

[21] Appl. No.: 688,093

[52] U.S. Cl. ..... 36/7.1 R; 36/9 R
[51] Int. Cl.[2] ..... A43B 3/16; A43B 1/02
[58] Field of Search ..... 36/9 R, 9 A, 7.1 R

[56] References Cited

UNITED STATES PATENTS

| | | | |
|---|---|---|---|
| 2,846,784 | 8/1958 | Bush | 36/9 R |
| 3,399,470 | 9/1968 | Schofield | 36/7.1 R |

*Primary Examiner*—Patrick D. Lawson
*Attorney, Agent, or Firm*—Gustave Miller

[57] ABSTRACT

This device is a protective foot covering that may be worn on the human foot either with a shoe on the foot, without a shoe on the foot, or barefoot. It consists of a sole the average length of a foot, and an elongate rectangular that is a length equal to the outer outerperimeter of the sole piece and secured about such entire perimeter and then the ends of the rectangular piece are also secured together, thus providing a tubular ankle embracing body located equidistantly from each end of the sole piece. Both parts are made of heavy cloth, preferably terry cloth. Then an elastic selvage is secured about the tubular end, and a second elastic selvage may also be placed about said tubular body but spaced intermediate the end selvedge and the connection to the sole piece, so that, when drawn over the foot or shoe, the end selvage is above the ankel and the lower selvage is below the ankle. It may be placed over the shoe or foot in either direction, as well as inside out, and serves equally in either position.

8 Claims, 5 Drawing Figures

PROTECTIVE FOOT COVERING

OBJECTS OF THE INVENTION

It is an object of this invention to provide a foot protector that may be worn over the bare foot, over the foot wearing a sock or stocking or also wearing a shoe.

A further object of this invention is to provide a foot protector made of a heavy, protective cloth, such as terry cloth, which will protect the floor from being scratched or damaged by a heavy shoe or boot and, in effect, will serve rather to polish the floor.

A further object of this invention is to provide a shoe or foot covering which may be readily folded for storage and which may be easily washed, as in a washing machine, for instance, after use.

A still further object of this invention is to provide a shoe or foot covering which can be easily and quickly placed over a shoe or foot without regard to front, back, inside or outside, and which will hold itself to the foot or shoe in use.

A still further object of this invention is to provide a shoe or foot covering or protector that may be economically manufactured and marketed at a low price and affords low economical expenditure for replacement.

Yet a further object of this invention is to provide a material which can absorb small portions of liquid from the floor to help prevent tracking of such liquid over the adjacent area.

Still a further object of this invention is to provide a Protective Foot and Shoe Covering that is an improvement over that shown in U.S. Pat. Nos. 2,305,926; 2,628,438; 2,896,339; 3,143,870; 3,503,077; 3,648,109; and all other prior art.

BRIEF DESCRIPTION OF THE FIGURES

With the above and related objects in view, this invention consists of the details of construction and combination of parts, as will be more fully understood from the following description when read in conjunction with the accompanying drawings, in which.

DETAILED DESCRIPTION OF THE INVENTION

Figure 1:
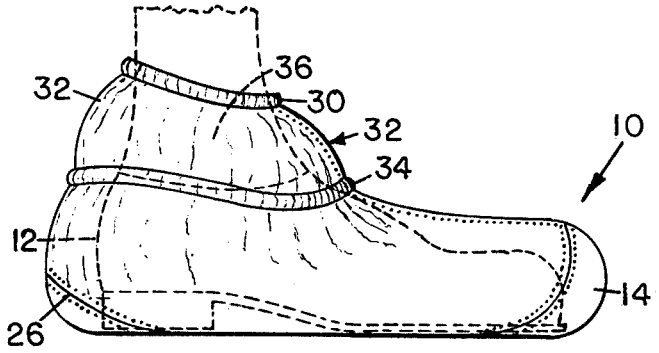
FIG. 1 is a side elevation of the protective foot or shoe covering of this invention, a human foot being inserted therein.

There is shown at 10 the foot or shoe protector of this invention in operative use on a human foot wearing a shoe 12. This protector consists of two cloth pieces, a sole piece 14 shaped substantially as shown, that is, a rectangle having straight sides 16 and semi-corcular ends 18, and an upwardly extending elongated rectangular piece 20 whose length 22 is equal to the complete perimeter of the sole piece 14, that is, equal to the length of the two equal sides 16 plus the two semi-circular ends 18, and whose height 24 is approximately equal to the desired height that the protector 10 is to extend above the sole 14.

To assemble this foot protector, the long rectangular piece of cloth 20 has one of its long sides sewed or otherwise attached along the entire perimeter 16, 18, 16 and 18 of the sole piece 14, as at 26, and the two short sides 24 are then likewise attached together, as at 28. Preferably, but not necessarily, the vertical seam 28 will be located at the mid point of one semi-circle 18 for symmetry.

One or more courses of elastic rubber or Spandex yarn 30 is attached along the free end of the tubular portion 32 formed by the piece 20 providing a selvage and a second similar elastic yarn 34 is secured intermediate the selvage 36 and the seam 26, these elastic yarns 30 and 34 being so spaced that the end selvage 30 locates above the human foot ankle 36, and lower yarn 34 locates below the ankle 36.

Figure 2:
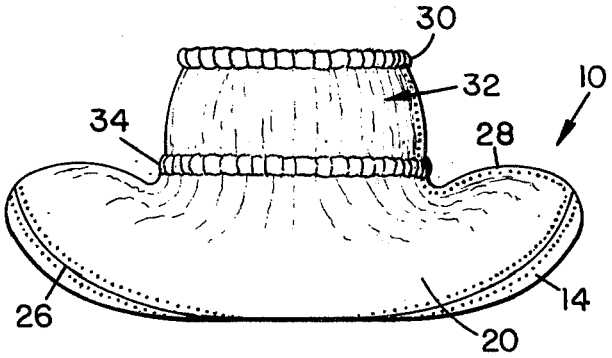
FIG. 2 is a side elevation of the covering per se.
Figure 3:
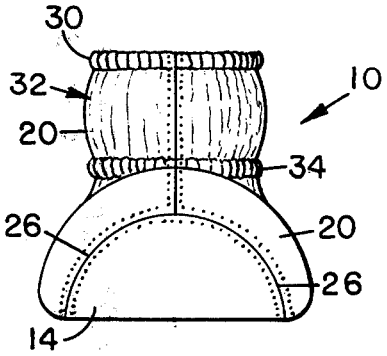
FIG. 3 is an end elevation of FIG. 2.
Figure 4:
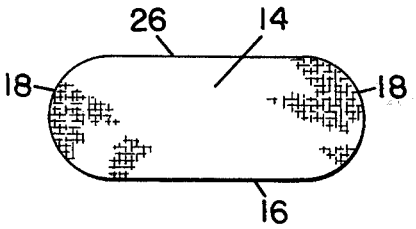
FIG. 4 is a top elevation of the protector sole, before being assembled.
Figure 5:
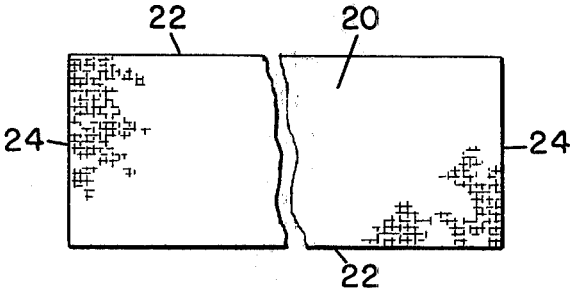
FIG. 5 is a top plan view, broken away, of the piece of material forming the ankle encircling band.

As will be noted from FIG. 2 and FIG. 3, as thus constructed, both ends of the protector 10 appear identical except for the presence of vertical seam 28. There is thus no "front" or "back" of this protector 10, and it can be worn inside out or outside in. In one position, seams 26 and 28, as well as the stitching about the elastic yarn 30 and 34 will be conspicuous; in the other position of wearing, such seams will be substantially quite inconspicuous. The foot protector 10 may be placed over the foot or shoe with the tubular seam 28 at either the front or the back of the foot, and for the average adult, one size and shape will fit either foot of about everyone, and whichever foot it is placed on, or whichever end is front or back, it will look as though it was made for that foot and size, as shown in FIG. 1.

The material of the protector will preferably, although not necessarily, be the well known "terry" cloth or towel material, although substantially any equivalent material or synthetic material may be used. With this type of material, it is ready washable and sterilizable in hot water or in a washing machine.

OPERATION OF THIS INVENTION

In operation, this protector 10 may be installed on either foot, a pair of identical protector coverings being used at a time. It may be worn over the bare foot, over socks or stockings, or over shoes 12, as shown in FIG. 1. It protects the foot or shoe from elements such as dust, dirt, plaster, etc.; it prevents sand and dirt from being carried into boats, cars and homes; it absorbs moisture, such as dew or snow, to help prevent tracking in homes, cars and boats. It helps to shine waxed floors; it absorbs small spills, such as coffee, tea, milk or water from tile, wood or other non-porous surfaces.

It is very desirable to be worn to prevent slipping when getting out of the shower onto a tile, ceramic or marble floor.

It prevents shoe polish from rubbing off on clothes while packed in suitcases for traveling.

It is completely washable and drier safe and can be sterilized.

It is economical to manufacture and to sell.

ABSTRACT OF THE DRAWINGS

In the drawings, like numbers refer to like parts, and for the purpose of explication, set forth below are the numbered parts of the improved FOOT PROTECTOR of this invention.

10 Foot Protector
12 shoe
14 sole
16 straight sides of sole 14
18 semi-circular ends of 14
20 elongated side piece
22 long side of 20
24 short ends of 20

26 seam on sole 24 to one side 22 or 20
28 seam forming tubular portion 32
30 selvage end Spandex yarn
32 tubular portion
34 intermediate Spandex yarn
36 human ankle Although this invention has been described in considerable detail, such description is intended as being illustrative rather than limiting, since the invention may be variously embodied.

Having thus set forth and disclosed the nature of this invention, what is claimed is:

1. A protective foot covering comprising a sole piece (14) having straight side (16) and semi-circular ends (18) and a rectangular piece (20) of a length to be attached to the perimeter (16, 18) of said sole piece (14) completely about its edge, said rectangular piece (20) being also secured together along its meeting edges (28) and extending above said sole piece, thereby providing an ankle embracing tubular body (32) located equidistant between said opposite ends of said sole piece (14), and an elastic selvage (30) secured to and entirely about the top end of said tubular body (32), whereby said covering (10) may be extended over the foot in either direction.

2. The foot covering of claim 1, said covering being of heavy cloth material.

3. The foot covering of claim 2, said cloth material being terry cloth.

4. The foot covering of claim 3, said foot covering being wearable either side out.

5. A protective foot covering comprising a sole piece (14) and a rectangular piece (20) of a length to be attached to the perimeter (16, 18) of said sole piece (14) completely about its edge, said rectangular piece (20) being also secured together along its meeting edges (28) and extending above said sole piece, thereby providing an ankle embracing tubular body (32) located equidistant between said opposite ends of said sole piece (14), whereby said covering (10) may be extended over the foot in either direction, and an elastic selvage (30) secured to the top end of said tubular body (32), and a second elastic selvage (34) secured about said tubular body (32) and spaced from said first mentioned selvage (30) to embrace the foot below the ankle (36) while said first mentioned selvage (30) embraces the foot above the ankle.

6. The foot covering of claim 5, said covering being of heavy cloth material.

7. The foot covering of claim 6, said cloth material being terry cloth.

8. The foot covering of claim 7, said foot covering being wearable either side out.

* * * * *